United States Patent [19]

Whorlow

[11] Patent Number: 5,070,716

[45] Date of Patent: Dec. 10, 1991

[54] LOCKING MECHANISM

[75] Inventor: Simon Whorlow, Eastern Green, United Kingdom

[73] Assignee: Rover Group Limited, England

[21] Appl. No.: 477,237

[22] Filed: Feb. 8, 1990

[30] Foreign Application Priority Data

Feb. 23, 1989 [GB] United Kingdom ..... 8904155

[51] Int. Cl.[5] ..... E05B 27/00

[52] U.S. Cl. ..... 70/492; 70/380; 70/419

[58] Field of Search ..... 70/492, 491, 379 R-380, 70/419, 422

[56] References Cited

U.S. PATENT DOCUMENTS

| | | | |
|---|---|---|---|
| 2,016,602 | 10/1935 | Jacobi | 70/492 |
| 2,068,405 | 1/1937 | Fitzgerald | 70/419 |
| 2,096,719 | 10/1937 | Johnstone | 70/419 |
| 3,524,335 | 8/1970 | George | 70/491 |
| 4,369,642 | 1/1983 | Grell | 70/380 X |
| 4,385,510 | 5/1983 | Harper | 70/492 |
| 4,773,240 | 9/1988 | Foshee | 70/422 X |
| 4,794,772 | 1/1989 | Falk et al. | 70/491 |
| 4,903,512 | 2/1990 | Leroy et al. | 70/380 X |

FOREIGN PATENT DOCUMENTS

| | | | |
|---|---|---|---|
| 1960900 | 10/1979 | Fed. Rep. of Germany | 70/491 |

*Primary Examiner*—Gary L. Smith
*Assistant Examiner*—Suzanne L. Dino
*Attorney, Agent, or Firm*—Davis, Bujold & Streck

[57] ABSTRACT

A locking mechanism is provided for locking and unlocking a vehicle door latch mechanism. The locking mechanism includes a housing (17) for securing to the vehicle, a barrel (1) rotatable within the housing, a drive (7, 37) selectively engageable between the barrel and the door latch mechanism and means (23) to disengage the drive, wherein the barrel (1) has an unlocked and a locked mode such that rotational movement of the barrel in the unlocked mode is communicated to the door latch mechanism via the drive (7, 37), while rotation of the barrel in the locked mode operates the disengaging means (23) to disengage the drive.

14 Claims, 2 Drawing Sheets

LOCKING MECHANISM

BACKGROUND TO THE INVENTION

The present invention relates to locking mechanisms for closures and more particularly to door and boot locking mechanisms for motor vehicles.

A locking mechanism is known which includes a housing fixed to a vehicle the housing having a barrel rotatably mounted therein which is renderable into unlocked and locked modes respectively by insertion of a key into or withdrawal of the key from the barrel. In this mechanism the barrel, with the correct key inserted, locks and unlocks a door latch mechanism permanently connected thereto by rotation of the barrel in one direction or the other respectively. Rotation of the barrel, and hence unlocking of the door latch mechanism, is prevented with the barrel in the locked mode by a series of tumblers extending radially of the barrel into engagement with the fixed housing.

It is a disadvantage of this type of locking mechanism that the mechanism may be forced by forcible rotation of the barrel which will result either in breakage of the tumblers or rotation of both the housing and barrel with respect to the door; both of these eventualities enabling unauthorised unlocking of the door latch mechanism.

It is an object of the present invention to provide a locking mechanism in which forcible rotation of the barrel, when in the locked mode, will not unlock a door latch mechanism.

SUMMARY OF THE INVENTION

According to the present invention there is provided a locking mechanism for locking and unlocking a door latch mechanism, the locking mechanism including a housing for securing to a vehicle, a barrel rotatable within the housing, a drive selectively engageable between the barrel and the door latch mechanism and means to disengage the drive, wherein the barrel has an unlocked and a locked mode such that rotational movement of the barrel in the unlocked mode is communicated to the door latch mechanism via the drive, whilst rotation of the barrel in the locked mode operates the disengaging means to disengage the drive.

The locking mechanism according to the invention thus gives the advantage that it cannot be forced by forcible rotation of the barrel to allow unauthorised unlocking of the door latch mechanism.

The drive preferably includes driving and driven elements which are coaxial with the barrel and which are axially movable with respect to each other selectively to engage or disengage the drive.

The disengaging means may include means rotatable with the barrel when in the locked mode, said rotatable means producing said relative axial movement between the elements of the drive on being rotated with the barrel.

The relative axial movement between the drive elements may be produced by a cam mechanism, by a thread mechanism or by any other suitable mechanism which will produce axial movement of the rotatable means upon rotation thereof.

The rotatable means may extend as a sleeve around the barrel between the barrel and the housing and be connectible to the barrel, when in the locked mode, by a further drive extensible between a periphery of the barrel and itself; and the axial movement mechanism may thus conveniently operate between the sleeve and the housing.

Once the disengaging means has disengaged the drive, the drive will preferably only be permitted to re-engage when the barrel is rotated to a pre-determined position. This position will normally be that in which a key may be inserted or withdrawn from the barrel. The permitted re-engagement of the drive may occur when one or more cams in a said cam mechanism engage co-operating recesses in cam follower means.

A shaft may extend centrally and axially from one end of the barrel and may have a said driving element thereon. A said driven element, which may be in the form of an arm, may be slidably mounted on the shaft for selective engagement with the driving element to be rotatably driven by the shaft when engaged therewith. The driven element is preferably urged towards the driving element by a resilient means, e.g. a spring.

When the barrel is rotated in the locked mode sufficient lost motion is desirably allowed between the barrel and door latch mechanism for the drive to be disengaged before the latch mechanism is unlocked.

In a preferred embodiment stop means is engageable with the driven element, when the drive is disengaged, to prevent any movement of the driven element. The stop means is conveniently operable to stop the driven element rotating with respect to the housing.

BRIEF DESCRIPTION OF THE DRAWINGS

The invention will now be more particularly described with reference to a preferred embodiment thereof as illustrated in the accompanying drawings of which.

DESCRIPTION OF THE PREFERRED EMBODIMENT

Figure 1:
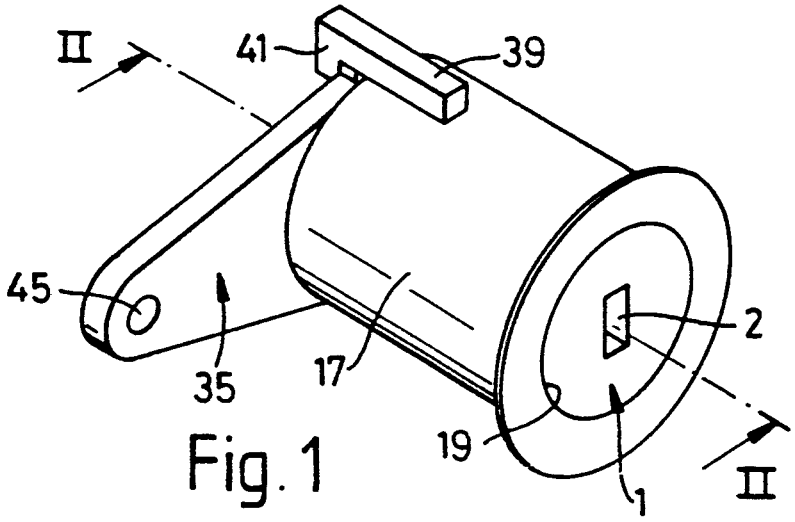
FIG. 1 is a perspective view of a locking mechanism according to the invention.

Referring to the drawing, the mechanism includes a cylindrical barrel 1 having a keyway 2, the barrel being renderable into unlocked and locked modes respectively by insertion and withdrawal of an appropriate key (not shown) from the keyway 2. The barrel has a shaft 3 extending axially from one end 5 thereof. The shaft 3 has part of a drive in the form of a square drive 7 adjacent the end 5, a land 9 adjacent the square drive 7 and a circlip groove 11 adjacent the land 9.

A series of tumblers 13 extend, when the barrel is in its locked mode, radially outwardly from a periphery 15 of the barrel on either side thereof.

The barrel 1 is rotatably mounted in a housing 17 and axially located therein by a flange 19. The flange 19 locates in an annular recess 21 in the housing 17.

Surrounding the barrel 1 is rotatable means in the form of a cylindrical sleeve 23. The sleeve has a pair of grooves 25 extending internally therealong to receive the tumblers 13 of the barrel 1, the grooves together with the tumblers forming a further drive.

The sleeve 23 includes part of a cam mechanism in the form of a circular axially extending face cam 27 having four lobes 29 thereon. The face cam 27 co-operates with another part of the cam mechanism in the form of a follower 31 having recesses 33, each corresponding to a lobe 29.

Another part of the drive namely a driven element in the form of an arm 35 has a square drive aperture 37 loosely co-operating with the square drive 7 rotatably to drive, with the required lost motion, the arm 35 upon rotation of the barrel 1 in its unlocked mode.

The housing 17 has a stop in the form of a leg 39 having a foot 41 on a free end thereof extending towards the barrel axis. The foot 41 is positioned to engage a slot 43 in the arm 35 when the arm is positioned on the land 9 of the shaft 3. The arm 35 has a small aperture 45 for attachment of the arm to a latch mechanism (not shown).

A coil spring 49 is interposed between a thrust washer 51 which bears against a circlip 53 located in the circlip groove 11 and the arm 35 resiliently to urge the arm into engagement with the square drive 7.

Figure 2:
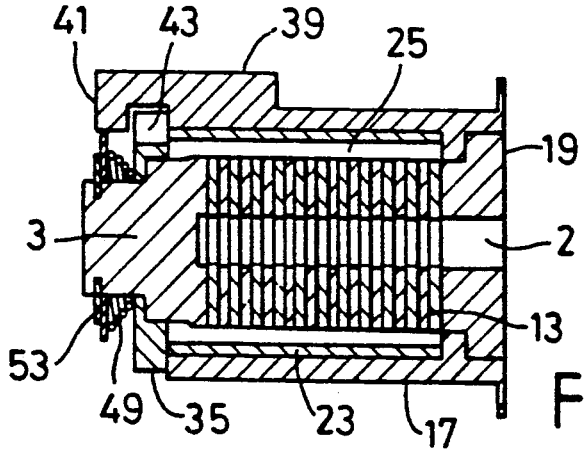
FIG. 2 is a sectional view of the mechanism taken along the line II—II of FIG. 1, shown assembled and with its drive engaged.
Figure 3:
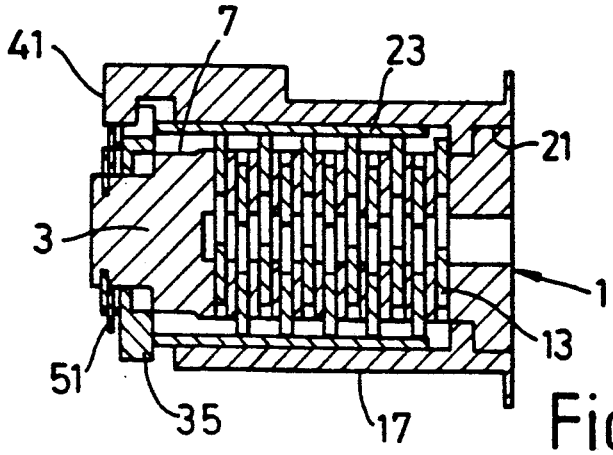
FIG. 3 shows the mechanism of FIG. 2 but with the drive disengaged.
Figures 4, 5:
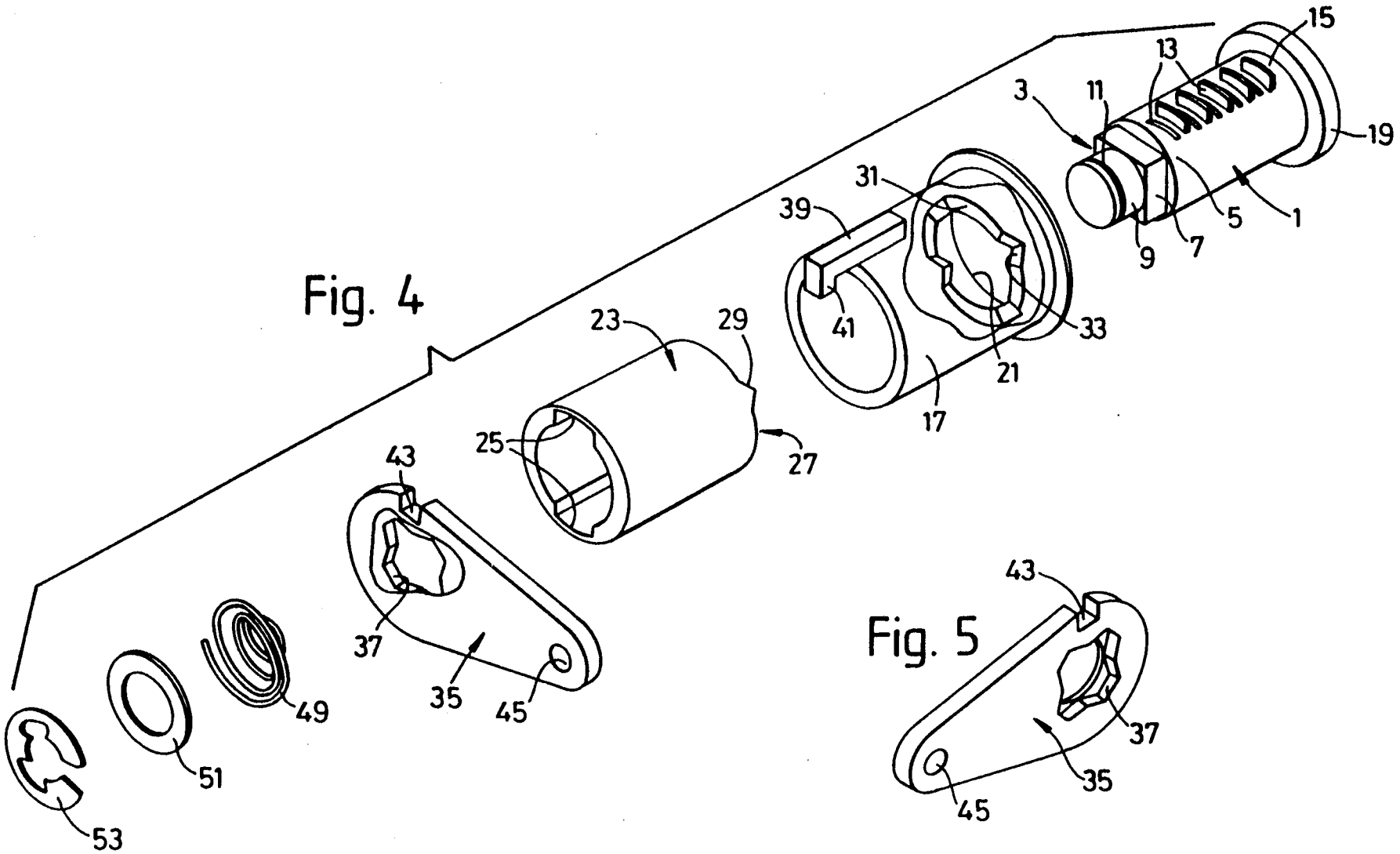
FIG. 4 is an exploded diagrammatic perspective view partly cut away of the locking mechanism of FIG. 1.
FIG. 5 is a perspective view of an arm to operate a latch.

FIGS. 2 and 3 schematically show the position of the tumblers 13 with the correct key (not shown) inserted into the keyway 2 (FIG. 2) and with no key at all (FIG. 3). In operation with the correct key inserted, the tumblers 13 will all be retracted within the barrel periphery 15, the coil spring 49 will be urging the arm 35 into engagement with the square drive 7, and rotation of the barrel 1 by the key will cause rotation of the arm 35 and thereby unlock or lock the latch mechanism, according to the direction in which the barrel is rotated.

With the barrel 1 in the unlocked mode the coil spring 49 will not only urge the arm into engagement with the square drive 7, but will also urge the recesses 33 on the follower 31 of the sleeve 23 into intimate contact with the cam lobes 29 of the face cam 27 and thus prevent rotation of the sleeve 23 during rotation of the barrel while unlocking or locking the latch mechanism.

When an incorrect key or other unauthorised instrument is inserted into the keyway 2 at least some of the tumblers 13 will protrude from the periphery 15 of the barrel and engage the grooves 25 in the sleeve 23. Attempts to unlock or lock the latch mechanism by rotation of the barrel will thus cause the sleeve 23 to rotate therewith thus rotating the cam lobes 29 with respect to the follower 31 and causing movement of the sleeve along the barrel axis. This in turn will urge the arm 35, against the resilient force of the coil spring 49, along the shaft 3 to disengage the square drive.

Disengagement of the square drive takes place over just a few degrees of rotation of the barrel 1, and the barrel is linked to the latch mechanism sufficiently loosely through the appropriately formed square drive aperture 37 so that lost motion provided by the loose linkage allows disengagement of drive before unlocking or locking of the latch mechanism takes place.

When the arm 35 is positioned on the land 9 the foot 41 becomes engaged in the slot 43 of the arm to prevent unauthorised or accidental rotation of the arm. Such accidental rotation might occur otherwise for example after extensive use in corrosive climates where unwanted friction coupling between the barrel and arm may result.

It will be appreciated that the barrel 1 and sleeve 23 will be free to rotate through 360° within the housing 17 when the drive is disengaged. If the barrel 1 is left, after an unauthorised attempt to operate the latch, in a position other than as shown in FIG. 1, insertion of the correct key and rotation of the barrel to the position of FIG. 1 will allow the corresponding cams and recesses to re-engage one another whereupon the coil spring will urge the arm 35 back into engagement with the square drive 7 whilst returning the sleeve to its inoperative position. The arm 35 may then be turned in the desired direction by turning the key in the barrel to unlock or lock the latch mechanism.

I claim:

1. A locking mechanism for locking and unlocking a door latch mechanism, said locking mechanism including a housing for securing the locking mechanism to a vehicle, a barrel rotatable within said housing, an engaged drive between said barrel and the door latch mechanism and means to disengage said drive, wherein said barrel is renderable into an unlocked and a locked mode with respect to said disengaging means by insertion and withdrawal of an appropriate key, respectively, such that rotational movement of said barrel in said unlocked mode is communicated to the door latch mechanism via said drive, whilst rotation of said barrel in said locked mode operates said disengaging means to disengage said drive.

2. A locking mechanism as in claim 1, wherein said drive includes driving and driven elements which are coaxial with said barrel and which are axially movable with respect to each other selectively to engage or disengage said drive.

3. A locking mechanism as in claim 2, wherein said disengaging means include means rotatable with said barrel when in said locked mode, said rotatable means producing said relative axial movement between said elements of said drive on being rotated with said barrel.

4. A locking mechanism as in claim 3, wherein said relative axial movement between said elements of said drive is produced by a cam mechanism.

5. A locking mechanism as in claim 4, wherein said rotatable means extend as a sleeve around said barrel between said barrel and said housing and are connectible to said barrel, when said barrel is in said locked mode, by a further drive extensible between a periphery of said barrel and said rotatable means

6. A locking mechanism as in claim 5, wherein said cam mechanism is operable between said sleeve and said housing.

7. A locking mechanism as in claim 6, wherein said drive is only permitted to re-engage when said barrel is rotated to a pre-determined position.

8. A locking mechanism as in claim 7, wherein re-engagement of said drive is permitted upon one or more cams of said cam mechanism engaging one or more co-operating recesses in cam follower means.

9. A locking mechanism as in claim 2, wherein a shaft extends centrally and axially from one end of said barrel and has a said driving element thereon with a said driven element being slidably mounted on said shaft for selective engagement with said driving element.

10. A locking mechanism as in claim 1, wherein sufficient lost motion is allowed in said drive between said barrel and the door latch mechanism for said drive to be disengaged before the latch mechanism is unlocked, when said barrel is rotated in said locked mode.

11. A locking mechanism as in claim 2, wherein stop means is engageable with said driven element, when said drive is disengaged, to prevent any movement of said driven element.

12. A locking mechanism as in claim 8, wherein a shaft extends centrally and axially from one end of said barrel and has a said driving element thereon with a said driven element being slidably mounted on said shaft for selective engagement with said driving element by the action of a spring, sufficient lost motion being allowed in said drive between said barrel and the door latch mechanism for said drive to be disengaged before the latch mechanism is unlocked, when said barrel is rotated in said locked mode.

13. A locking mechanism as in claim 12, wherein stop means are provided to be engageable with said driven element, when said drive is disengaged, to prevent any movement of said driven element.

14. A locking mechanism for locking and unlocking a door latch mechanism, said locking mechanism including a housing for securing the locking mechanism to a vehicle, a barrel rotatable within said housing, an engaged drive means connected to transmit locking and unlocking rotation of said barrel to the door latch mechanism when a correct key is properly positioned in the barrel, and means to disengage the engaged drive means to prevent transmission of said locking and unlocking rotation of said barrel to the door latch mechanism unless a correct key is properly positioned in the barrel.

* * * * *